United States Patent [19]

McCabe

[11] Patent Number: 4,938,190

[45] Date of Patent: Jul. 3, 1990

[54] THROTTLE PLATE ACTUATOR

[75] Inventor: Ralph P. McCabe, Troy, Mich.

[73] Assignee: Colt Industries Inc., New York, N.Y.

[21] Appl. No.: 347,913

[22] Filed: May 5, 1989

[51] Int. Cl.[5] ..... F02B 77/00; F02D 9/08

[52] U.S. Cl. ..... 123/399; 123/361

[58] Field of Search ..... 123/399, 361, 352; 180/178, 179

[56] References Cited

U.S. PATENT DOCUMENTS

| | | | |
|---|---|---|---|
| 4,724,811 | 2/1988 | Maisch | 123/361 |
| 4,727,838 | 3/1988 | Oshiage et al. | 123/361 |
| 4,745,899 | 5/1988 | Kiuchi et al. | 123/361 |
| 4,747,380 | 5/1988 | Ejiri et al. | 123/399 |
| 4,781,162 | 11/1988 | Ishikawa et al. | 123/399 |
| 4,785,777 | 11/1988 | Hock et al. | 123/352 |
| 4,809,659 | 3/1989 | Tamaki et al. | 123/399 |
| 4,850,322 | 7/1989 | Uthoff et al. | 123/399 |

FOREIGN PATENT DOCUMENTS

| | | | |
|---|---|---|---|
| 0128431 | 8/1983 | Japan | 123/399 |

*Primary Examiner*—Raymond A. Nelli

*Attorney, Agent, or Firm*—Howard S. Reiter

[57] ABSTRACT

A throttle plate actuator and apparatus for controlling the pivotal position of a carburetor or throttle body throttle plate. The throttle plate actuator includes a rotor having a rotatable shaft mounted in a housing. First and second permanent magnets of opposite polarity directions are mounted on the rotatable shaft in spaced, facing relationship. A stator in the form of an electromagnet constructed of first and second pole pieces normally surrounds the facing portions of the first and second permanent magnets. At least one electrical conductor is wound in a plurality of turns to form a winding about each pole piece. When energized, the windings induced a magnetic field in the pole pieces which generate a predetermined magnetic torque proportional to the amount of current flowing through the windings to overcome the bias of the return spring attached to the throttle plate so as to rotate the rotor and attached throttle plate a predetermined angular amount. The throttle plate actuator apparatus includes a control unit responsive to accelerator pedal position and the throttle plate position and parameters stored in a control program to control the amount of current supplied to the windings of the stator.

9 Claims, 5 Drawing Sheets

THROTTLE PLATE ACTUATOR

BACKGROUND OF THE INVENTION

Field of the Invention:

The present invention relates, in general, to naturally asperated engines and, more specifically, to throttle plate position control devices for either carbureted or fuel injected engines.

In most typical internal combustion engines, the throttle plate in the carburetor or throttle body is connected by a mechanical linkage to the vehicle accelerator pedal. Any movement of the accelerator pedal is transmitted by the linkage to pivotal movement of the throttle plate to control the amount of air drawn into the engine and thereby the air/fuel mixture to control the acceleration or deceleration of the vehicle.

However, electrically operated throttle actuation are also available, and typical electric motor, throttle actuators for automotive use include conventional D.C. motors, stepper motors or brushless D.C. motors that may be attached to the throttle directly or through the use of gearing. Some of the above actuators require use of (a) more than two electric wires, a disadvantage in automotive applications, or (b) a complex (and thus less reliable) electronic control, such as the brushless D.C. motor.

An actuator embodying the present invention is directly coupled to the throttle shaft, to avoid the unreliability associated with potential gear failure, and requires only two connecting wires. Additionally, the proposed control is more size efficient than prior art limited travel actuators wherein magnetic flux passed through a toroidally wound coil wherein only that portion of the coil facing the permanent magnet rotor is magnetically active, while in the actuator embodying this invention all of the coil is active in producing torque.

While such prior art actuators have proven to be generally reliable, it is believed that further improvements can be made to control the position of the throttle plate. Specifically, the improvements contemplated by the invention are directed toward optimizing vehicle powertrain requirements, optimizing acceleration and deceleration versus fuel economy capabilities, reducing vehicle emissions and providing vehicle powertrain protection.

It is proposed that such improvements replace the mechanical linkage between the throttle plate and the accelerator pedal with an electronic control unit and a throttle plate actuator responsive to the accelerator pedal position and the position of the throttle plate itself.

Specifically, it is considered desirable to provide an apparatus for directly controlling the throttle plate position in response to accelerator pedal position without the use of a conventional mechanical linkage connected between the throttle plate and the vehicle accelerator pedal. It is also desirable to provide a throttle plate actuator which is (a) self contained and directly controls the pivotal movement of the throttle plate, (b) space efficient, (c) easily constructed, (d) provides long reliability and (e) exhibits efficient heat dissipation.

SUMMARY OF THE INVENTION

The present invention is a throttle plate actuator and apparatus for controlling the position of the throttle plate of an internal combustion engine. The actuator includes a motor whose output shaft is fixedly connected at one end to the throttle plate. The motor includes rotor means formed by first and second permanent magnets having opposite polarity directions mounted on the shaft in facing, spaced relationship.

A stator in the form of an electromagnet is disposed about the first and second permanent magnets. The stator or electromagnet is formed of first and second opposed pole pieces of magnetizable material which surround opposed, facing portions of the first and second permanent magnets. At least one electrical conductor is wound in a plurality of turns about each pole piece to form a winding. The windings are wound in opposite directions about each respective pole piece and are connected in series to generate opposed polarity magnetic fields in each of the first and second pole pieces.

Electric current supplied to the electrical conductors in each winding generates a magnetic field in each pole piece creating magnetic torque between each pole piece and the spaced permanent magnets. This results in a predetermined amount of angular rotation of the permanent magnets, the rotatable shaft and the attached throttle plate depending upon the magnitude of the electric current. The amount of torque is selected to overcome the bias of a return spring attached to the throttle plate which normally biases the throttle plate to a closed position.

The throttle plate actuator apparatus includes a control means for operating the actuator. The control means is responsive to the accelerator pedal position as generated by a pedal position sensor, the throttle plate position as generated by a throttle position sensor and a stored control program which controls the amount of current supplied to the windings depending upon vehicle operating conditions, pedal position, throttle position, etc.

In a preferred embodiment, the control means is a central processing unit or computer which executes a stored control program.

The throttle plate actuator and apparatus of the present invention provides direct replacement of the mechanical linkage employed between the accelerator pedal and the throttle plate. The actuator and apparatus are of simple construction. The windings in the actuator are wound on bobbins for ease of assembly. Further, the actuator is space efficient and has excellent heat dissipation characteristics.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
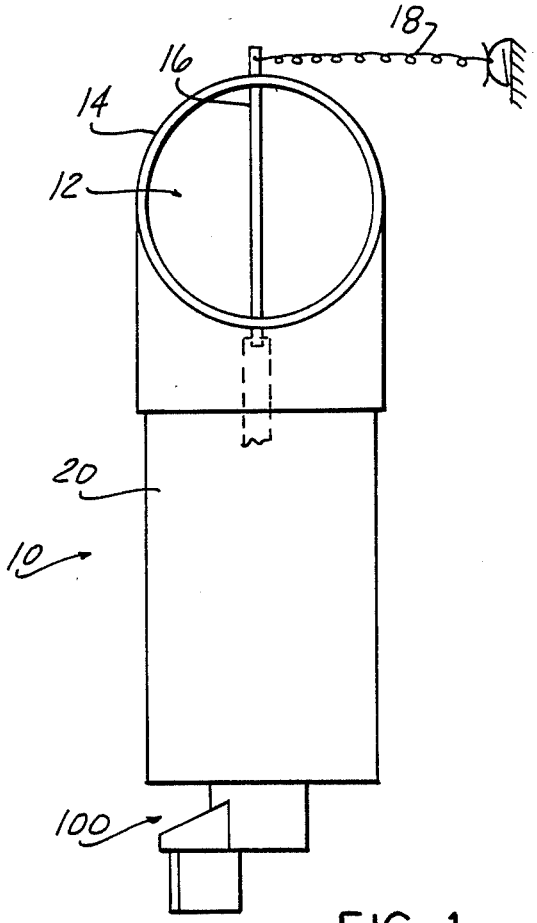
FIG. 1 is a plan view of the throttle plate actuator of the present invention connected to a carburetor throttle plate.

Throughout the following description and drawing, an identical reference number is used to refer to the same component shown in multiple figures of the drawing.

Referring now to the drawing, and to FIG. 1 in particular, there is illustrated a throttle plate actuator 10 which controls the position of a conventional throttle plate 12 in the throttle body 14 of an internal combustion engine. As is conventional, the throttle plate 12 comprises a thin, circular disk disposed in the air intake of the throttle body 14. A rod or shaft 16 extends through or is joined to the throttle plate 12 and extends outward through the sidewall of the carburetor body 14. A return spring 18 is connected to one end of the shaft 16 to normally bias the throttle plate 12 to a closed position. As is conventional, the throttle plate 12 is moved to varying angular positions to control the amount of air drawn into the throttle body 14 to thereby control the air/fuel mixture charged to the engine.

It should be noted that while the following discussion is depicted with a single bore throttle body 14, the present invention may also be employed with multistage or multi-bore throttle bodies, as will be described in grater detail hereafter.

Figure 2:
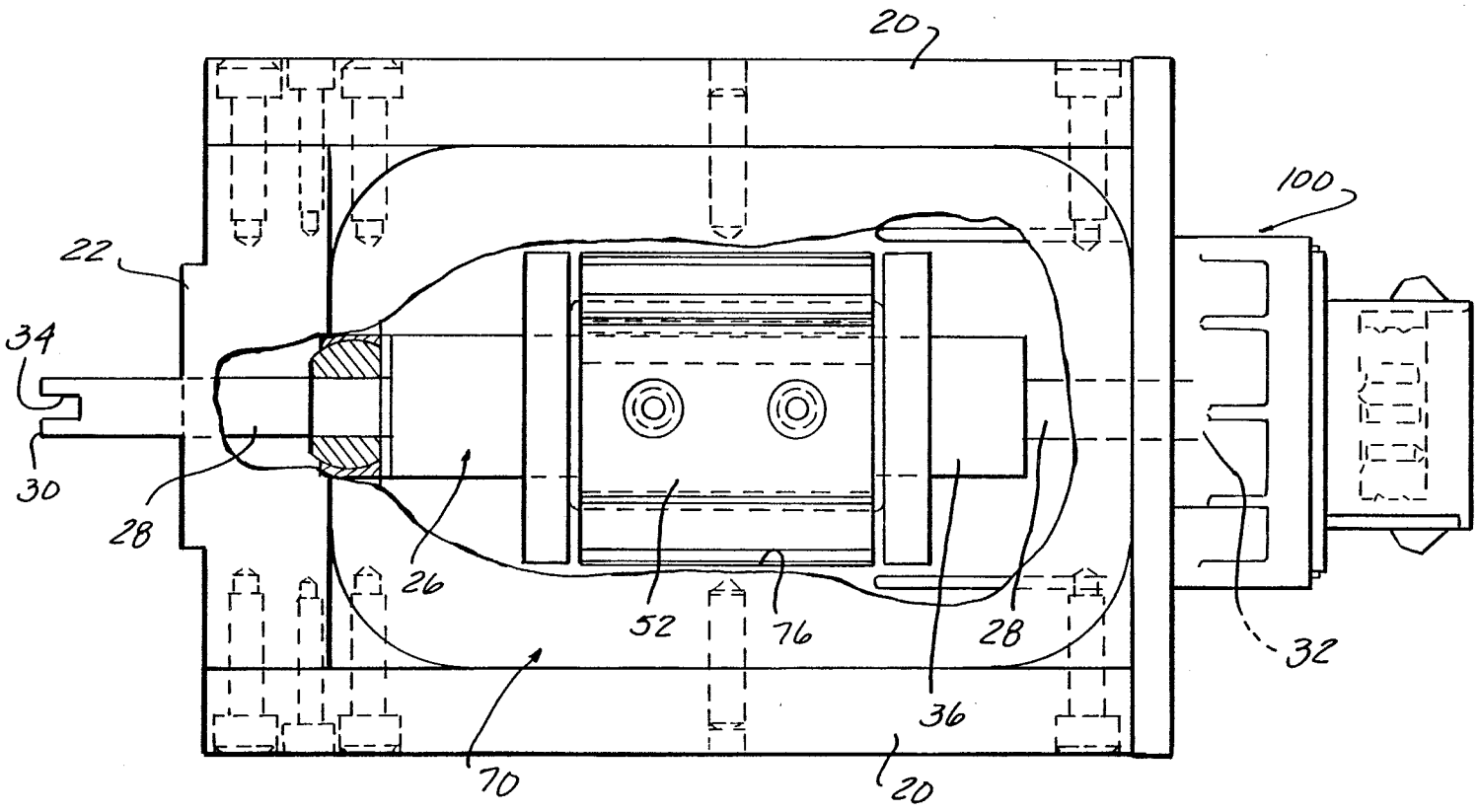
FIG. 2 is a partially broken away, plan view of the throttle plate actuator shown in FIG. 1.
Figure 3:
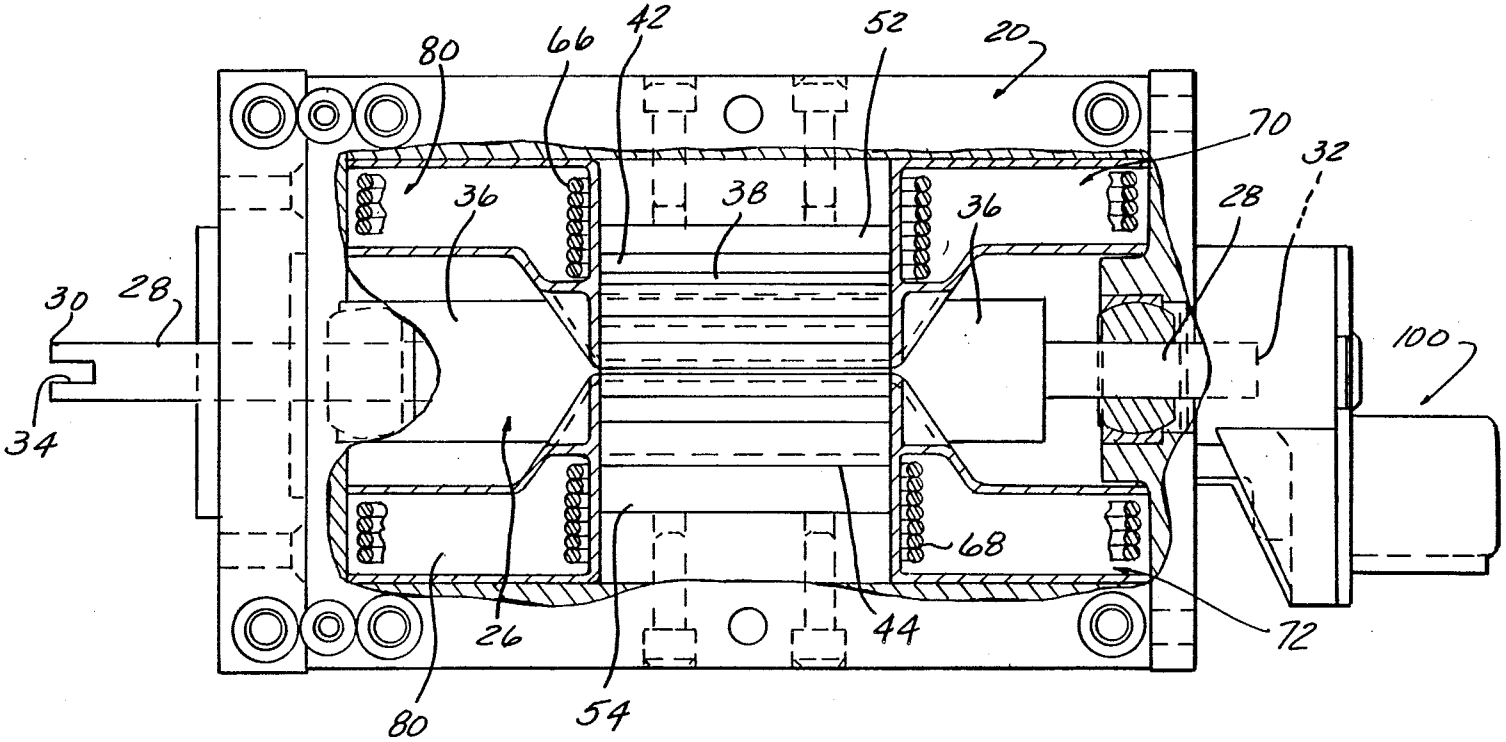
FIG. 3 is a partially broken away, left-hand side view of the throttle plate actuator shown in FIG. 2.
Figure 4:
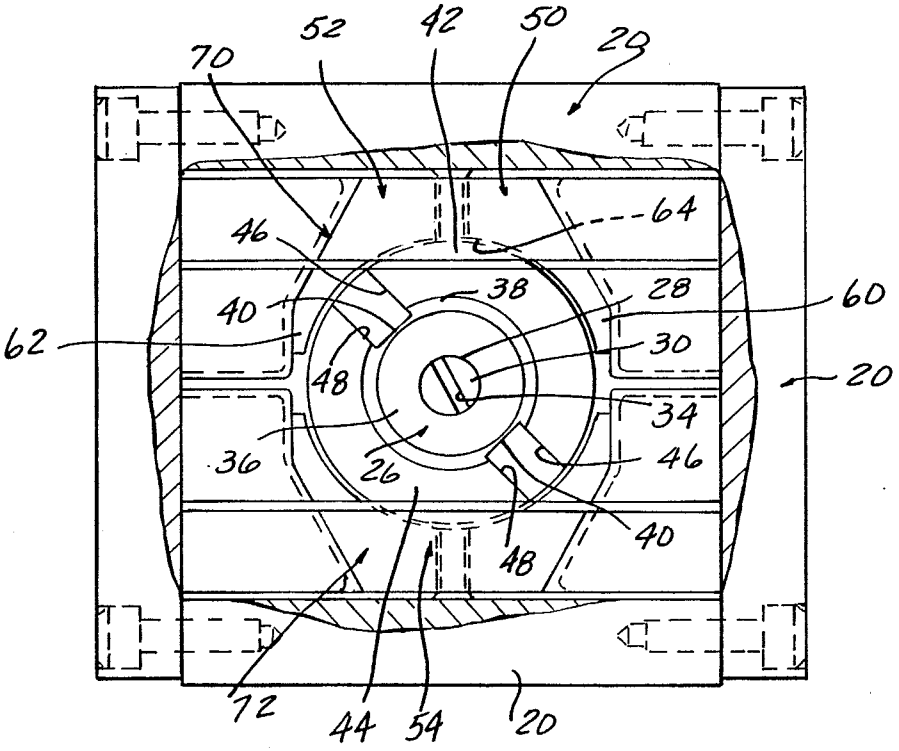
FIG. 4 is a partially broken away, top end view of the throttle plate actuator shown in FIG. 2.

As shown in FIG. 1, and in greater detail in FIGS. 2, 3 and 4, the throttle plate actuator 10 includes an external housing formed of a plurality of interconnected plates 20, 22 and 24. The housing has a generally rectangular form and is configured to mount alongside the carburetor 14 as shown in FIG. 1. The plates 20 are arranged as side walls and opposed first and second ends are respectively denoted by reference numbers 22 and 24. The housing 20 contains the operative components of the throttle plate actuator 10 which constitute a motor, preferably a two pole D.C. motor.

The motor includes a rotor means denoted in general by reference number 26 in FIG. 2-5. The rotor 26 is shown in greater detail in FIG. 6. The rotor 26 is formed of an elongated, cylindrical shaft 28 having a first end 30 and a second end 32. Each of the ends 30 and 32 is provided with a transverse notch 34, the reasons for which will be described in greater detail hereafter. The shaft 28 is preferably formed of cold rolled steel with a nickel plating.

Figure 5:
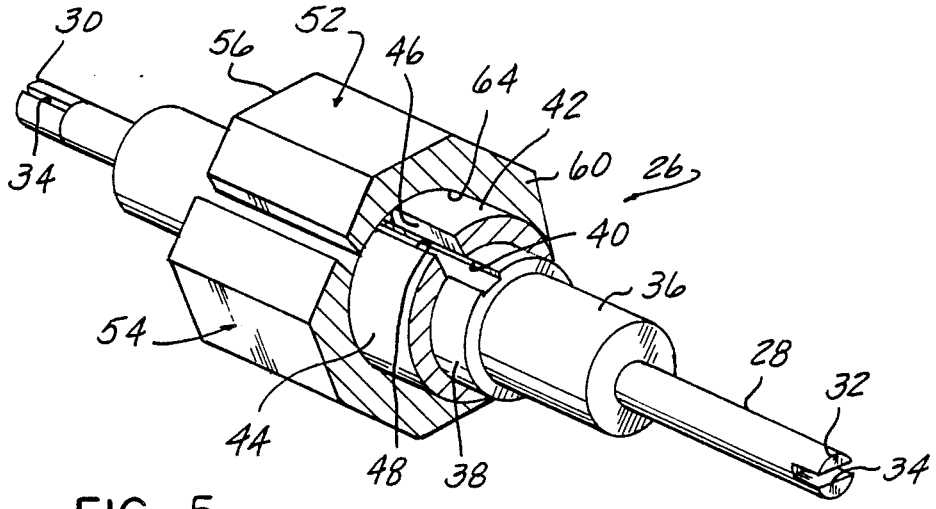
FIG. 5 is a perspective view of the rotor and a portion of the stator of the throttle plate actuator.

An intermediate portion 36 of the rotor 26 has an enlarged cross section and is secured to the shaft 28. A further central portion 38 is fixedly mounted centrally along the length of the intermediate portion 36 as shown in FIG. 5. The central portion contains two lengthwise extending depressions or notches 40.

The rotor 26 also includes first and second permanent magnets 42 and 44, respectively. The permanent magnets 42 and 44 are formed of a magnetic material and are constructed with opposite directions of polarity. By this it is meant that, in the orientation shown in FIG. 5, the first permanent magnet 42 is provided with a "north" polarity at its upper end and a "south" polarity at its lower end adjacent the central cylindrical portion 38 of the rotor 26. The second permanent magnet 44 has an opposite polarity direction with a "north" polarity disposed adjacent the cylindrical central portion 38 and a "south" polarity at the outermost peripheral surface of the second permanent magnet 44.

Each of the permanent magnets 42 and 44 has a generally hemispherical shape. The permanent magnets 42 and 44 are further formed of a predetermined circumferential length such that opposed faces 46 and 48, disposed on each side of the central portion 38 of the rotor 26, are spaced apart a predetermined distance as shown in FIG. 5. The faces 46 and 48 align with the edges of the notches 40 such that the space between the faces 46 and 48 is aligned with the notch 40. The permanent magnets 42 and 44 are attached, preferably by bonding via a suitable adhesive, to the central portion 38 of the rotor 26.

The throttle plate actuator 10 also includes a stator or electromagnet denoted in general by reference number 50 in FIG. 4. The stator 50 is formed of at least two magnetizable pole pieces and associated electrical windings. As shown in FIGS. 2-5, first and second pole pieces 52 and 54, respectively, are provided in the stator 50. Each of the pole pieces, such as pole piece 52, is formed with a generally flat base 56 and two outwardly extending arms 58 and 60. A circular, generally hemispherical surface 64 extends between the ends of the arms 60 and 62 of each pole piece, such as pole piece 52. Each of the pole pieces 52 and 54 has a circumferential length substantially the same as the length of the permanent magnets 42 and 44.

As shown in FIGS. 4 and 5, each of the pole pieces 52 and 54 is disposed within the housing in a surrounding, spaced relationship with the permanent magnets 42 and 44. The pole pieces 52 and 54 are oriented such that the ends of the arms 60 and 62 overlap the opposed, spaced faces 46 and 48 of the permanent magnets 42 and 44 when the stator is de-energized. Suitable fasteners, such as mounting screws, are provided for holding each of the pole pieces 52 and 54 in position in the housing.

At least one electrical winding surrounds each of the pole pieces 52 and 54. Each winding is formed of an electrical conductor would in a plurality of turns about a pole piece 50 or 52. Thus, winding 66 is formed about pole piece 52 and winding 68 about pole piece 54. The number of turns and the cross section or diameter of the conductor forming the windings 66 and 68 is chosen for the particular application to which the throttle applicator 10 is designed. Both the diameter of the electrical conductor and/or the number of turns may be varied as desired.

To facilitate the construction of the windings 66 and 68 and to simplify the overall assembly of the throttle plate actuator 10, the windings 66 and 68 are wound about bobbins 70 and 72, respectively. Each of the bobbins 70 and 72 is identically constructed and the following description will be provided only for bobbin 70.

Figure 6:
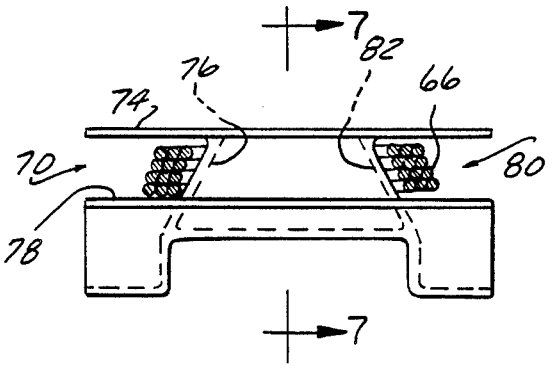
FIG. 6 is an end view of the bobbin employed with the electric windings of the throttle plate actuator.
Figure 7:
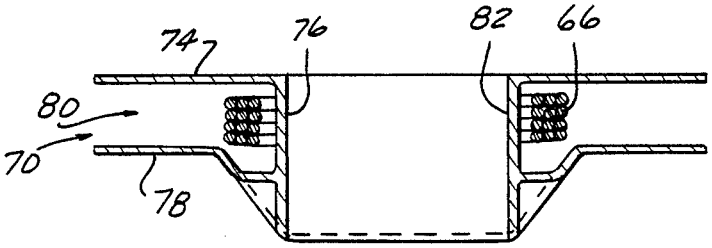
FIG. 7 is a cross sectional view generally taken along line 7—7 in FIG. 6.

Bobbin 70 is formed of an electrically insulating material, such as a suitable plastic. As shown in FIGS. 2, 6 and 7, the bobbin 70 includes a planar plate 74 of generally oval configuration. A centrally located, substantially rectangular aperture 76 is formed within the plate 74. A bottom, planar portion 78 is also integrally formed on the bobbin 70 and is spaced from the plate 74 to form a cavity 80 therebetween. The cavity 80 is configured to surround the associated pole piece 52 and receives the electrical winding 66 therein.

A centrally located bore 82 is formed in the bobbin 70 and is configured to snugly engage the exterior surface of the associated pole piece, such as the pole piece 52 shown in FIG. 4, so as to place the electrical winding 66 in close, surrounding magnetic relationship with the associated pole piece 52.

The windings 66 and 68 are wound in the same direction about the pole pieces 52 and 54, respectively. Further, the ends of the windings 66 and 68 are connected in series, FIG. 8, such that the direction of current flow through the winding 66 is opposite from the direction of current flow in winding 68.

As is well known, the flow of electrical current through a coil or winding generates a magnetic field in a magnetizable member surrounded by the winding. The strength of the magnetic field and the resulting magnetic torque exerted by the magnetizable member, such as the pole pieces 52 and 54, depends on the magnitude of the electric current and is directly proportional thereto.

Due to the series connections of the windings 66 and 68 about the respective pole pieces 52 and 54 and the opposed polarity directions of the permanent magnets 42 and 44, the flow of electric current through the series connected windings 66 and 68 will generate a magnetic field of one polarity in the pole member 52 and a magnetic field of an opposite polarity in the pole piece 54. This exerts a magnetic torque on the permanent magnets 42 and 44 causing pivotal movement or rotation of the rotatable shaft 28 and the connected throttle plate 12 by an angular amount proportional to the magnetic torque generated by the stator 50.

It should be noted that the magnetic torque generated by the stator 50 overcomes the bias exerted by the return spring 18 to move the throttle plate 12 to any desired angular position thereby controlling the amount of air drawn into the throttle body 14 and the resultant air charge to the engine. It should also be noted that varying the electrical current flowing through the windings 66 and 68 varies the amount of magnetic torque causing a result in change in the angular position of the rotatable shaft 28 and attached throttle plate 12.

Figure 8:
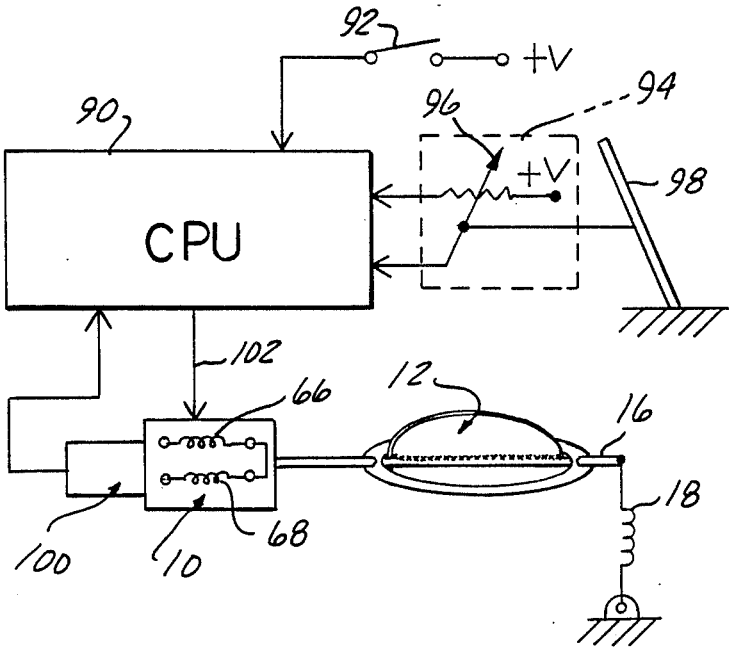
FIG. 8 is a schematic view showing the throttle plate actuator apparatus of the present invention.

The throttle plate actuator apparatus of the present invention includes the above-described throttle plate actuator 10 in combination with a control means or unit responsive to various inputs, described thereafter, which controls the amount of current supplied to the windings 66 and 68 of the throttle plate actuator 10. As shown in FIG. 8, the control means preferably comprises a central processing unit 90 or computer. The central processing unit 90 may be any central processing unit, such as a microprocessor or microcomputer, which receives inputs, executes a stored control program, and generates outputs. The central processing unit 90 may be a stand along unit dedicated specifically to the throttle plate actuator apparatus of the present invention or may be implemented in the onboard computer utilized in conventional vehicle engines.

The central processing unit 90 receives an input voltage through an energization or start switch 92 which may be the ignition switch of the vehicle. Also input to the central processing unit 90 is the output of an accelerator pedal position sensor 94. The accelerator pedal position sensor 94 may comprise any type position sensor, such as a potentiometer, connected between a voltage source and the central processing unit 90. The wiper portion 96 of the sensor 94 is connected to the vehicle accelerator pedal 98 as shown in FIG. 8 by a suitable mechanical connection. In this manner, the position of the accelerator pedal 98 is converted to an electrical signal by the sensor 94 which is input to the central processing unit 90.

Also input to the central processing unit 90 is the output of a throttle position sensor 100. The throttle position sensor 100 is connected to the second end 32 of the rotatable shaft 28 of the rotor 26 and provides a signal indicative of the actual angular position of the throttle plate 12. The throttle position sensor 100 may alternately be mounted on the throttle plate shaft 16. Further details concerning the construction of the exemplary throttle position sensor may be had by referring to U.S. Pat. application Ser. No. 07/335,797, filed Apr. 10, 1989, assigned to the same assignee as the subject application, the contents of which are included herein in their entirety.

The central processing unit 90 receives the output signals from the accelerator position sensor 94 and the throttle position sensor 100 and executes a stored control program to generate a predetermined amount of electric current on reference line 102 which is supplied to the windings 66 and 68 of the throttle plate actuator 10 as described above to control the angular position of the throttle plate 12 and thereby the air/fuel mixture of the vehicle engine resulting in a predetermined acceleration or deceleration for the vehicle. The stored program is designed to operate on stored data to optimize acceleration and deceleration of the vehicle with respect to fuel efficiency, optimize acceleration and deceleration for lowest vehicle emissions, as well as protecting the power train of the vehicle from overloads.

Figure 9:
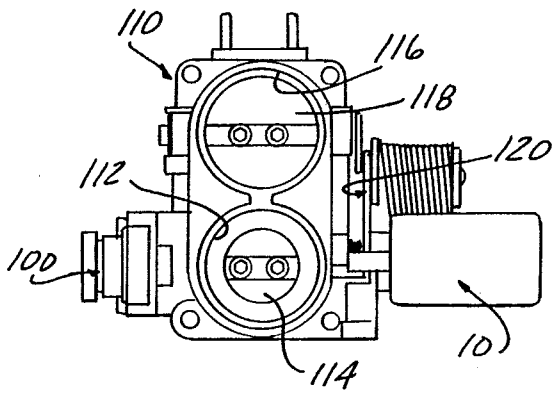
FIG. 9 is a plan view of the present invention mounted on a staged carburetor.

FIG. 9 depicts the throttle plate actuator 10 mounted on a staged throttle body 110. The throttle body, in an exemplary embodiment, includes two barrels 112 and 116, each having a pivotal throttle plate 114 and 118, respectively, mounted therein. The actuator 10 is fixedly connected to one throttle plate 114 in the manner described above to control the position of the throttle plate 114. A multiple link linkage 120 connects the two throttle plates 114 and 118 together for simultaneous, identical pivotal movement as controlled by the throttle plate actuator 10. The throttle position sensor 100 is illustrated as being connected to the throttle plate 114.

In summary, there has been disclosed a unique throttle plate actuator and apparatus which directly controls the actuation and angular position of the throttle plate in the throttle body of an internal combustion engine with respect to accelerator pedal position without a direct mechanical connection between the accelerator pedal and the throttle plate. The throttle plate actuator of the present invention is of simple construction for ease in manufacturing, good heat dissipation capabilities and minimal space requirements.

What is claimed is:

1. A throttle plate actuator for a carburetor or throttle body having a pivotal throttle plate biased by a return spring to a closed throttle position and pivotal against the bias of the return spring in response to accelerator pedal position, the throttle plate actuator comprising:

a rotatable shaft fixedly connected at one end to the throttle plate;

permanent magnet means, fixedly mounted on the rotatable shaft and having a predetermined direction of polarity; and electromagnet means, disposed in spaced relation to the permanent magnet means and generating a magnetic field when energized having a polarity opposed to the direction of polarity of the permanent magnet means, for rotating the permanent magnet means and the rotatable shaft an angular amount proportional to the strength of the magnetic field generated thereby.

2. The throttle plate actuator of claim 1 further including:

a housing;

the rotatable shaft being rotatably mounted in the housing with at least one end extending outward therefrom; and the electromagnet means being fixedly mounted in the housing in spaced, surrounding relationship with the permanent magnet means.

3. The throttle plate actuator of claim 1 wherein the electromagnetic means comprises:

a magnetizable pole piece surrounding in spaced relation at least a portion of the permanent magnet means; and at least one electrical conductor wound in a polarity of turns about the pole piece.

4. The throttle plate actuator of claim 3 wherein the electromagnet means further comprises:

a bobbin formed of an insulating material surrounding the pole piece;

the electrical conductor disposed within the bobbin.

5. The throttle plate actuator of claim 1 wherein the permanent magnet means comprises:

a first permanent magnet having a first polarity direction fixedly mounted about a portion of the rotatable shaft; and a second permanent magnet having a second polarity direction opposed to the direction of polarity of the first permanent magnet fixedly mounted about a portion of the rotatable shaft opposed to and facing the first permanent magnet;

the electromagnet means comprising:

a first magnetizable pole piece surrounding and spaced from a portion of the first and second permanent magnet;

a first electrical conductor wound in a first direction in a plurality of winding turns about the first pole piece;

a second magnetizable pole piece surrounding and spaced from a portion of the first and second permanent magnets opposed to and facing the first pole piece;

a second electrical conductor wound in a first direction in a plurality of winding turns about the second pole piece; and the first and second electrical conductors being electrically connected in series to generate magnetic fields in the first and second pole pieces, respectively, of opposite polarity.

6. A throttle plate actuator apparatus for a carburetor having a pivotal throttle plate biased by a return spring to a closed throttle position and pivotal against the bias of the return spring in response to accelerator pedal position, the throttle plate actuator apparatus comprising:

a rotatable shaft fixedly connected at one end of the throttle plate;

permanent magnet means, fixedly mounted on the rotatable shaft and having a predetermined direction of polarity;

electromagnet means, disposed in spaced relation to the permanent magnet means and generating a magnetic field when energized having a polarity opposed to the direction of polarity of the permanent magnet means, for rotating the permanent magnet means and the rotatable shaft an angular amount proportional to the strength of the magnetic field generated thereby; and control means, responsive to the accelerator pedal position and the throttle plate position, for generating an electric current in the electromagnetic means to generate a magnetic torque causing a predetermined amount of rotation of the rotatable shaft and the attached throttle plate in response to the position of the accelerator pedal and the throttle plate position.

7. The throttle plate actuator apparatus of claim 6 further including:

throttle position sensor means for sensing and providing an output signal indicative of the position of the throttle plate, the output signal of the throttle position sensor being input to the control means.

8. The throttle plate actuator apparatus of claim 7 wherein:

the throttle position sensor is fixedly connected to the other end of the rotatable shaft.

9. The throttle plate actuator apparatus of claim 6 further wherein:

the control means executes a stored control program and receives inputs from the accelerator pedal position sensor and the throttle plate position sensor to generate an electric current to the electromagnetic means to control the position of the throttle plate.

* * * * *